US006707172B2

(12) United States Patent
Tronolone et al.

(10) Patent No.: US 6,707,172 B2
(45) Date of Patent: Mar. 16, 2004

(54) SELF-NORMALLING JACK WITH ELECTRONICALLY CONTROLLED NORMAL CIRCUIT OR RELAY

(76) Inventors: James Tronolone, 56 Cedar Rd., Ringwood, NJ (US) 07456; Virginia Tronolone, 56 Cedar Rd., Ringwood, NJ (US) 07456

( * ) Notice: Subject to any disclaimer, the term of this patent is extended or adjusted under 35 U.S.C. 154(b) by 17 days.

(21) Appl. No.: 10/122,070

(22) Filed: Apr. 15, 2002

(65) Prior Publication Data

US 2003/0193246 A1 Oct. 16, 2003

(51) Int. Cl.[7] ..... H01H 3/00
(52) U.S. Cl. ..... 307/134; 307/139; 307/117
(58) Field of Search ..... 307/134, 139, 307/117; 439/668, 669

(56) References Cited

U.S. PATENT DOCUMENTS 5,246,378 A * 9/1993 Seiceanu ..... 439/188
5,550,755 A * 8/1996 Martin et al. ..... 340/825.36

* cited by examiner

*Primary Examiner*—Gregory J. Toatley, Jr.
(74) *Attorney, Agent, or Firm*—Clifford G. Frayne

(57) ABSTRACT

A self-normalling jack with an electronically controlled normal circuit or relay comprising a pair of receptacles having a sensing means for sensing the insertion of a plug, the sensing means in communication with an electronic normalling switch or relay, the electronic normalling switch or relay in communication with a paired receptacle such that the electronic normalling switch or relay is located between the source terminal and the upper jack and between the lower jack and the destination terminal. The electronically controlled normalling circuit or relay also connects the source to the destination when no patch cord is inserted into either the upper or lower jack receptacle. When the patch cord is inserted into the upper jack, the source signal is connected to the patch plug. When the patch cord is inserted into the lower jack, the destination signal is connected to the patch plug. Inserting a cord into either jack receptacle disconnects the source from the destination.

8 Claims, 1 Drawing Sheet

SELF-NORMALLING JACK WITH ELECTRONICALLY CONTROLLED NORMAL CIRCUIT OR RELAY

BACKGROUND OF THE INVENTION

1. Field of the Invention

The present invention relates to jack receptacles which receive patch cords, and in particular, to an electronic normalling circuit or electronic relay, controlled electronically by means of electronic sensors that sense when a plug on the end of a patch cord is inserted into a jack receptacle which increases reliability and bandwidth capability.

2. Description of the Prior Art

A self-normalling jack internally routes a signal from one electronic device to another. Typically connectors are used with the rear source (input), and rear destination (output). On the front are standard patch ports. The internal normal path runs from the rear source to the rear destination. The signal can be rerouted by inserting a patch cord into either front port. Removal of the patch cord returns the signal to the normal path (i.e. "self-normalled").

The mechanical self-normalling jack also suffers from the fact that continuous current flowing through it allows for contamination which can create a non-connection. It can also become contaminated by dust, dirt and developing a slight film which can cause a non-connection. Applicant's invention provides for a self-normalling jack with an electronically controlled normal circuit or relay.

OBJECTS OF THE INVENTION

An object of the present invention is to provide for an electronic self-normalling jack, the function of which is electronically incorporated by means of an electronic circuit.

Another object of the present invention is to provide for a novel electronically self-normalling jack which provides greater band width capability.

Another object of the present invention is to provide for a novel electronically self-normalling jack which provides for greater reliability.

Another object of the present invention is to provide for a novel electronically self-normalling jack which is less susceptible to contamination and possible non-connection.

Another object of the present invention is to provide for a self-normalling jack the function of which is controlled electronically and performed by an electronic circuit or an electronic relay.

SUMMARY OF THE INVENTION

A self-normalling jack with an electronically controlled normal circuit or relay comprising a pair of receptacles having a sensing means for sensing the insertion of a plug, the sensing means in communication with an electronic normalling switch or relay, the electronic normalling switch or relay in communication with a paired receptacle such that the electronic normalling switch or relay is located between the source terminal and the upper jack and between the lower jack and the destination terminal. The electronically controlled normalling circuit or relay also connects the source to the destination when no patch cord is inserted into either the upper or lower jack receptacle. When the patch cord is inserted into the upper jack, the source signal is connected to the patch plug. When the patch cord is inserted into the lower jack, the destination signal is connected to the patch plug. Inserting a cord into either jack receptacle disconnects the source from the destination.

BRIEF DESCRIPTION OF THE DRAWINGS

These and other objects of the present invention will become evident particularly when taken in light of the following illustrations wherein.

DETAILED DESCRIPTION OF THE DRAWINGS

Figure 1:
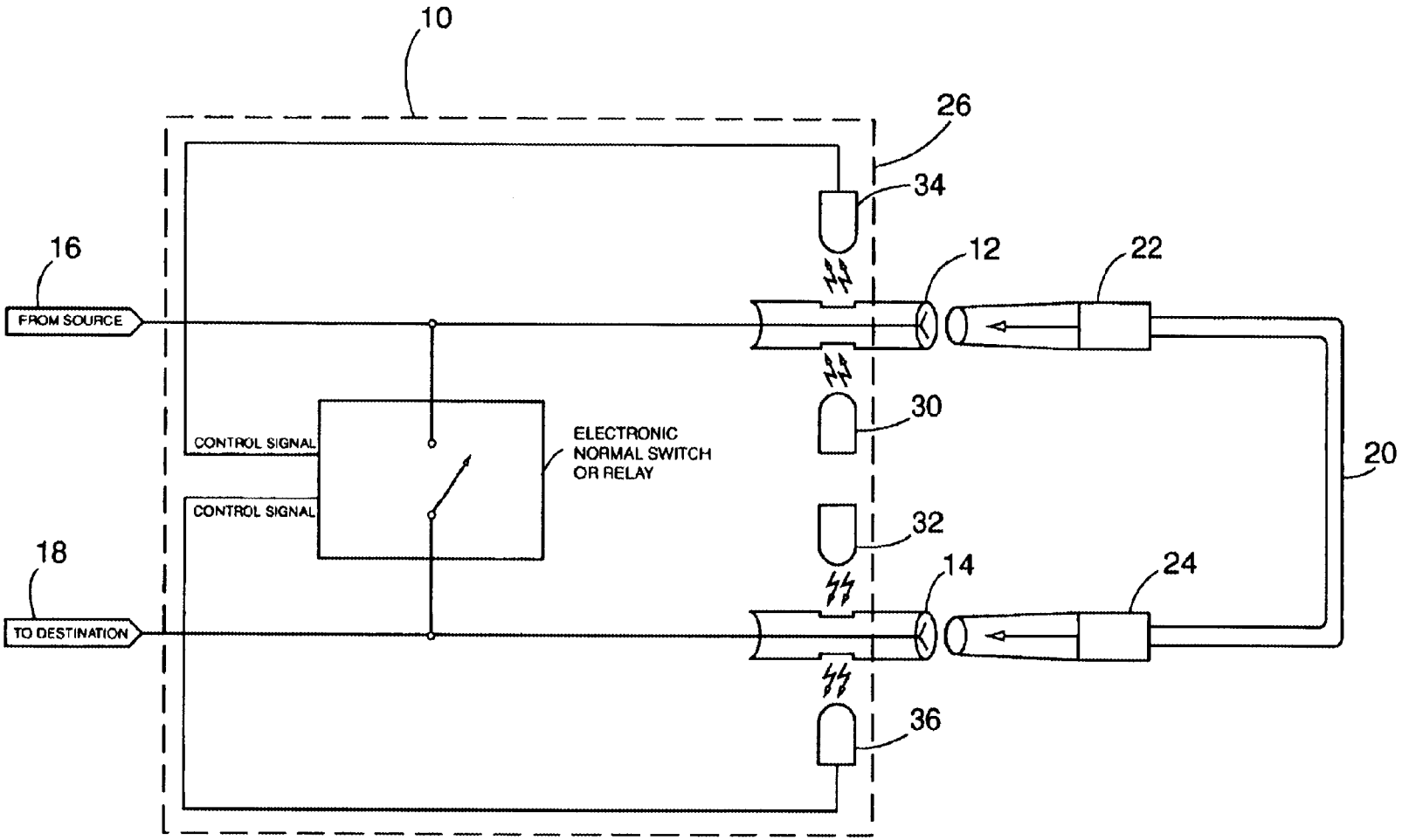
FIG. 1 is an electronic schematic diagram of the electronic self-normalling jack.

FIG. 1 is a schematic diagram of an electronically controlled self-normalling jack of the present invention. A self-normalling jack would be utilized in any type of electrical appliance having jack receptacles and designed to direct or redirect any signals such as audio, video, digital, telephone, data, fiber, fiber optics, or the like.

The circuit 10 is in communication with a first jack receptacle 12 and a second jack receptacle 14. A source signal 16 is in communication with the circuit and the circuit is in communication with a destination signal 18 for the signal. In order to redirect the signal, a patch cord 20 with associated plugs 22 and 24 are inserted into the first and second jack receptacles 12 and 14. Jack receptacles 12 and 14 have associated therewith, a detector device for generating a signal when plugs 22 or 24 are inserted into the respective jack receptacle. The sensing device 26 could be achieved by monitoring the signal that is applied to the receptacle or by using an optical sensor that would sense when the plug is inserted into the receptacle. In the embodiment illustrated in FIG. 1, each jack receptacle 12 and 14 has associated therewith a sensor emitting device 30 and 32 and a sensor receiving device 34 and 36. The sensor receiving devices are in communication with the electronic normalling switch or relay 40. The sensing device could be a light emitting diode and light sensor; infrared transmitting diode and receiving diode; or the insertion of the patch cord could close a contact generating the control signal. The sensing device would sense the presence or absence of a jack plug and electronically control the normalling switch or relay 40 for either an open or closed orientation.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

We claim:

1. A self-normalling jack having an electronically controlled normal circuit or relay for redirecting an electronic signal from its source to its destination comprising:

a first jack receptacle in communication with a signal source;

a second jack receptacle in communication with a destination source;

an electronic normalling switch in communication with said source signal and said destination signal;

a first sensing means in communication with said first jack receptacle and in communication with said electronic normalling switch or relay;

a second sensing means in communication with said second jack receptacle and in communication with said electronic normalling switch or relay, said first sensing means and said second sensing means signaling said electronic normalling switch to the presence or absence of a patch cord plug positioned in said first jack receptacle or said second jack receptacle, thereby respectively opening or closing said electronic normalling switch or relay for the redirection of said signal.

2. The self-normalling jack having an electronically controlled normalling circuit or relay in accordance with claim 1 wherein said sensing means comprises a light emitting diode and light sensor.

3. The self-normalling jack and electronically controlled normalling circuit or relay in accordance with claim 1 wherein said sensing means comprises an infrared transmitting diode and receiving diode.

4. The self-normalling jack with electronically controlled normalling circuit or relay in accordance with claim 1 wherein said sensing means comprises a contact means engagable with said patch cord plug to generate a signal to said electronic normalling switch or relay.

5. A method of self-normalling a jack to increase reliability and bandwidth capability, said method comprising:

positioning an electronic normalling switch or relay in communication with a source signal and a destination signal, said source signal and said destination signal being in communication with a first jack receptacle and a second jack receptacle;

positioning a first sensing means proximate said first jack receptacle;

positioning a second sensing means proximate said second jack receptacle, said first sensing means and said second sensing means in communication with said electronic normalling switch or relay;

generating a control signal from said first sensing means and said second sensing means to said electronic normalling switch indicating the presence or absence of a patch cord plug in said first jack receptacle or said second jack receptacle;

opening or closing said electronic normalling switch or relay responsive to said control signal signaling the presence or absence of a patch cord plug in said first jack receptacle or said second jack receptacle.

6. The method of self-normalling a jack in accordance with claim 5 wherein said sensing means comprises light emitting diode and light sensor.

7. The method of self-normalling a jack in accordance with claim 5 wherein said sensing means comprises an infrared transmitting diode and receiving diode.

8. The method of self-normalling a jack in accordance with claim 5 wherein said sensing means comprises a surface to surface contact between an electronic contact and the said patch cord plug.

* * * * *